US006430896B1

(12) United States Patent
Torikian

(10) Patent No.: US 6,430,896 B1
(45) Date of Patent: Aug. 13, 2002

(54) CAPPING MACHINE

(75) Inventor: Karnik Torikian, Montreal (CA)

(73) Assignee: Kalish, Inc., Montreal (CA)

( * ) Notice: Subject to any disclaimer, the term of this patent is extended or adjusted under 35 U.S.C. 154(b) by 0 days.

(21) Appl. No.: 09/533,544

(22) Filed: Mar. 23, 2000

(51) Int. Cl.[7] ..... B65B 7/28

(52) U.S. Cl. ..... 53/310; 53/314; 53/331.5

(58) Field of Search ..... 53/301, 302, 304, 53/306, 308, 311, 312, 317, 328, 331.5, 342, 345, 357, 314

(56) References Cited

U.S. PATENT DOCUMENTS 3,975,886 A * 8/1976 Waters ..... 53/310
5,012,630 A * 5/1991 Ingram et al. ..... 53/490
5,115,617 A * 5/1992 Lewis et al. ..... 53/306
6,105,343 A * 8/2000 Grove et al. ..... 53/490
6,115,992 A * 9/2000 Bankuty et al. ..... 53/308

* cited by examiner

*Primary Examiner*—John Sipos
*Assistant Examiner*—Hemant M. Desai
(74) *Attorney, Agent, or Firm*—Choate, Hall & Stewart

(57) ABSTRACT

The present invention relates to an apparatus for capping in succession containers transported on a conveyance device. The apparatus comprises a cap dispensing station for applying caps on the containers. The cap dispensing station includes a cap release passage, a gating unit and a movable cap ejector. The gating unit includes a barrier, capable to acquire either one of first and second operative positions, and a barrier drive mechanism. In the first operative position, the barrier at least partially closes the cap release passage for preventing a cap from freely travelling through the passage under the effect of gravity. In the second operative position, the barrier uncovers the cap release passage for allowing a cap to pass through the passage. The cap ejector engages the barrier drive mechanism such that the barrier drive mechanism causes the barrier to acquire the second operative position. The capping apparatus yields the benefit of repeatable accurate cap dispensing over containers to be capped, by virtue of the novel gating unit.

20 Claims, 8 Drawing Sheets

CAPPING MACHINE

FIELD OF THE INVENTION

The present invention relates to an apparatus for fitting containers with caps. More particularly, it is directed to a novel capping machine capable to deposit a cap on a container neck such that the cap is aligned with the container neck.

BACKGROUND OF THE INVENTION

In the bottling industry, reclosable containers are usually sealed with screw-type caps. To achieve a high productivity, the container sealing operation is performed by automatic capping machines processing in succession the containers transported in serial order on a conveyor belt or any other type of materials handling machine. In typical capping machines, the container sealing operation is a two-step process. Firstly, the open container passes underneath a cap dispensing station applying loosely on the container neck a screw-type cap in thread alignment with the threads on the container neck. For the purpose of this specification, the term "thread alignment" designates a condition where the cap is not threadedly engaged on the container neck, however the threads on the cap and on the neck respectively are so disposed that rotation of the cap will cause the threads to mate in the correct fashion, resulting in thread engagement. In contrast, the term "thread misalignment" will be used to identify a condition where rotation of the cap will cause improper thread engagement resulting in a poorly sealed container. The container is then transported to a cap tightening station where a chuck rotatably grips the cap, tightening it and sealing the container.

The accurate positioning of the cap on the container neck is an important operation to ensure a proper thread engagement during the cap tightening stage. Existing capping machines use a simple method to deposit the caps on the containers at the cap dispensing station. The caps are fed from a supply chamber or magazine to a cap-dropping aperture where a latch drops the caps on the containers in a timed relationship with the container feed rate. Unfortunately, although a cap is dropped only a very short distance from the top of a container neck, during its free fall the cap may tilt slightly, landing in an improper position on the container and failing to produce the desired thread alignment condition. Deep caps or caps with large threads have inherent self-centering capability and, accordingly, they can compensate, to a certain extent, for an imprecise positioning. However, shallow caps and caps with smaller thread sizes, have little ability to self-center themselves, in which case an improperly positioned cap will fail to produce a correct thread engagement during the cap tightening operation, resulting in a poorly sealed container.

In U.S. Pat. No. 5,115,617, issued on May 26, 1992 to H. G. Kalish Inc., a capping machine is disclosed in which the cap dispensing station includes a cap-dropping aperture partially closed by a resilient lip. This lip prevents a cap from travelling through the cap-dropping aperture. The cap dispensing station further includes a selectively actuatable cap ejector that drives the cap through the cap-dropping aperture against the resiliency of the lip, freeing the cap for deposit onto the container neck. Frictional engagement between the resilient lip and the cap during its movement through the cap-dropping aperture guides the cap such that it is precisely positioned on the container. Unfortunately, a weakness of this design is the wear suffered by the resilient lip over time, which causes the opening in the lip to become too large such that the lip can no longer hold a cap properly in place. Further, during movement of the cap through the cap-dropping aperture, the downward motion of the resilient lip may permit a tilting of the cap, resulting in a thread misalignment condition between the cap and the container neck.

The background information provided above clearly indicates that there exists a need in the industry to provide an improved mechanism for applying caps onto container necks within capping machines, such that accurate cap positioning is repeatedly achieved.

SUMMARY OF THE INVENTION

The present invention provides in one aspect an apparatus for capping in succession containers transported on a conveyance device. The apparatus includes a cap dispensing station for applying on each container a cap. The cap dispensing station includes a gating unit that controls the movement of a cap through a cap release passage. When the cap is allowed to travel through the cap release passage it is deposited onto a container underneath. The gating unit includes a barrier associated to the cap release passage, and a barrier drive mechanism associated to the barrier. In a first operative position, the barrier at least partially closes the cap release passage to prevent a cap from freely traveling through the passage under the effect of gravity. In a second operative position, the barrier uncovers the cap release passage to allow a cap to travel through the passage. The apparatus also comprises a movable cap ejector that engages the barrier drive mechanism such that the barrier drive mechanism causes the barrier to acquire the second operative position.

The capping apparatus as described above yields the benefit of repeatable accurate cap dispensing over containers to be capped, by virtue of the novel gating unit.

In a specific non-limiting example of implementation, the barrier drive mechanism of the gating unit includes a pair of arms slidingly mounted on tracks. The spacial position of the arms is such that they extend in the path of travel of the cap ejector. When the cap ejector moves toward the arms it engages the arms and causes the arms to move on the tracks. The arms are mounted to the barrier such that the movement of the arms causes the barrier to acquire the second operative position in which the cap release passage is uncovered. In particular, the barrier has a pair of portions, each portion mounted to a respective arm. Each barrier portion moves with the respective arm so as to uncover the cap release passage. When the cap has been deposited on the container, the cap ejector is withdrawn. The arms are spring-loaded and they move back to their initial rest position, causing the barrier portions also to move back to the first operative position, at least partially closing the cap release passage to prevent a cap from passing through the passage.

In a second broad aspect, the invention provides a capping machine including a cap ejector that can grasp the cap and transport the cap toward the container to be capped. Thus feature is advantageous in that the movement of the cap toward the container is well controlled which translates in a more accurate cap dispensing operation.

In a non-limiting example of implementation under the second broad aspect, the cap ejector includes a gripping device that engages and holds the cap, preventing it from moving freely under the effect of gravity. The cap ejector moves toward the container to carry the cap and deposit the cap on the container neck. When the cap ejector has reached the container neck it releases the cap such that the cap rests on the container neck, allowing the cap ejector to withdraw. In a specific non-limiting example of implementation, the gripping device includes a recess at the base of the cap ejector, dimensioned for receiving at least a portion of a cap. A fluid communication channel connected to a source of vacuum terminates in the recess to selectively establish a pressure differential therein. The pressure differential holds the cap in the recess against the force of gravity. The cap ejector then moves toward the container, transporting the cap with it. The pressure differential is terminated once the cap ejector has reached the container, allowing the cap to be released from the cap ejector.

In a possible variant, a motor in driving relationship with the cap ejector imparts a rotational movement to the cap ejector for threadedly engaging and tightening the cap on the container neck.

BRIEF DESCRIPTION OF THE DRAWINGS

These and other features of the present invention will become apparent from the following detailed description considered in connection with the accompanying drawings. It is to be understood, however, that the drawings are provided for purposes of illustration only and not as a definition of the boundaries of the invention, for which reference should be made to the appending claims.

DETAILED DESCRIPTION

Figure 1:
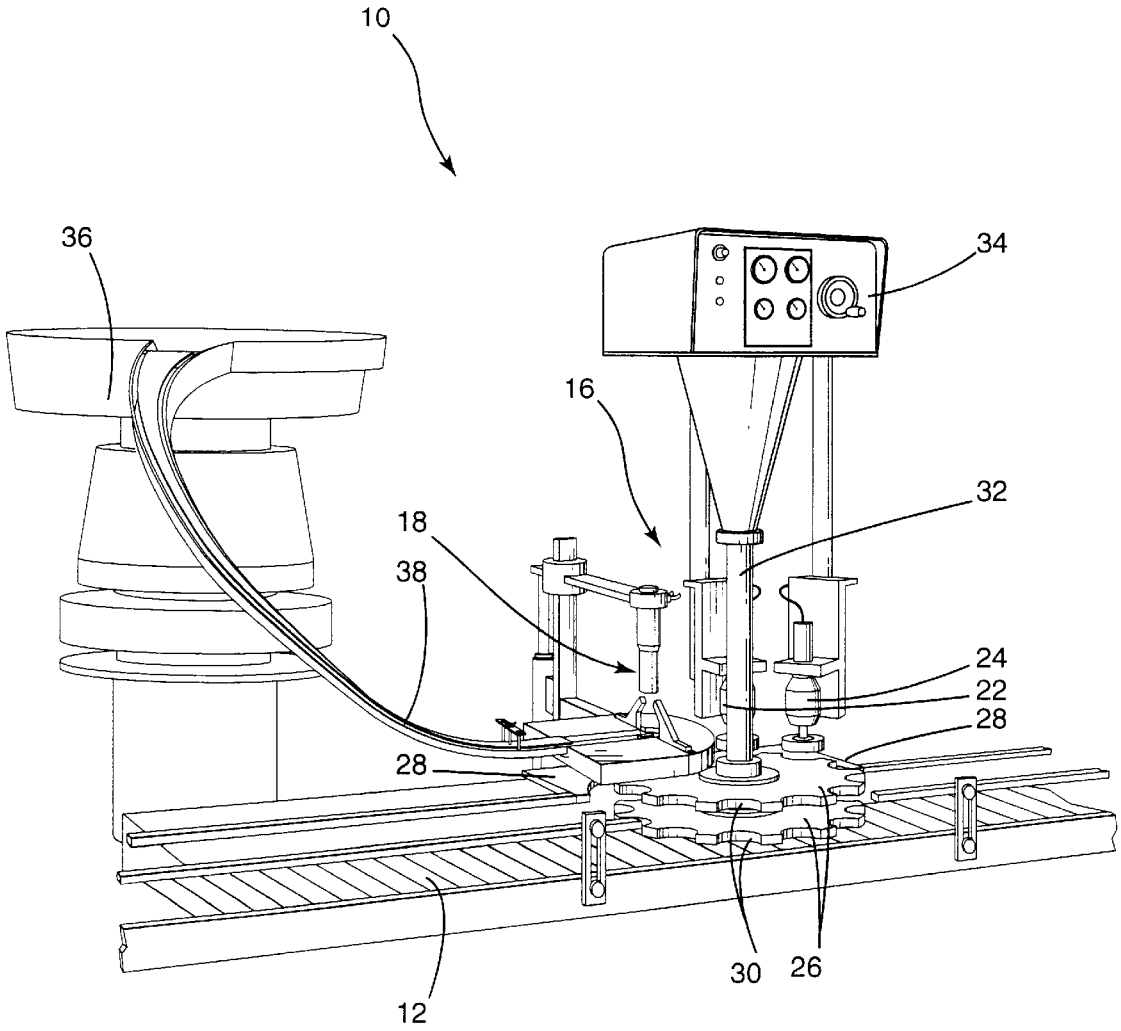
FIG. 1 is a perspective view of a capping machine constructed in accordance with an example of implementation of the present invention.
Figure 2:
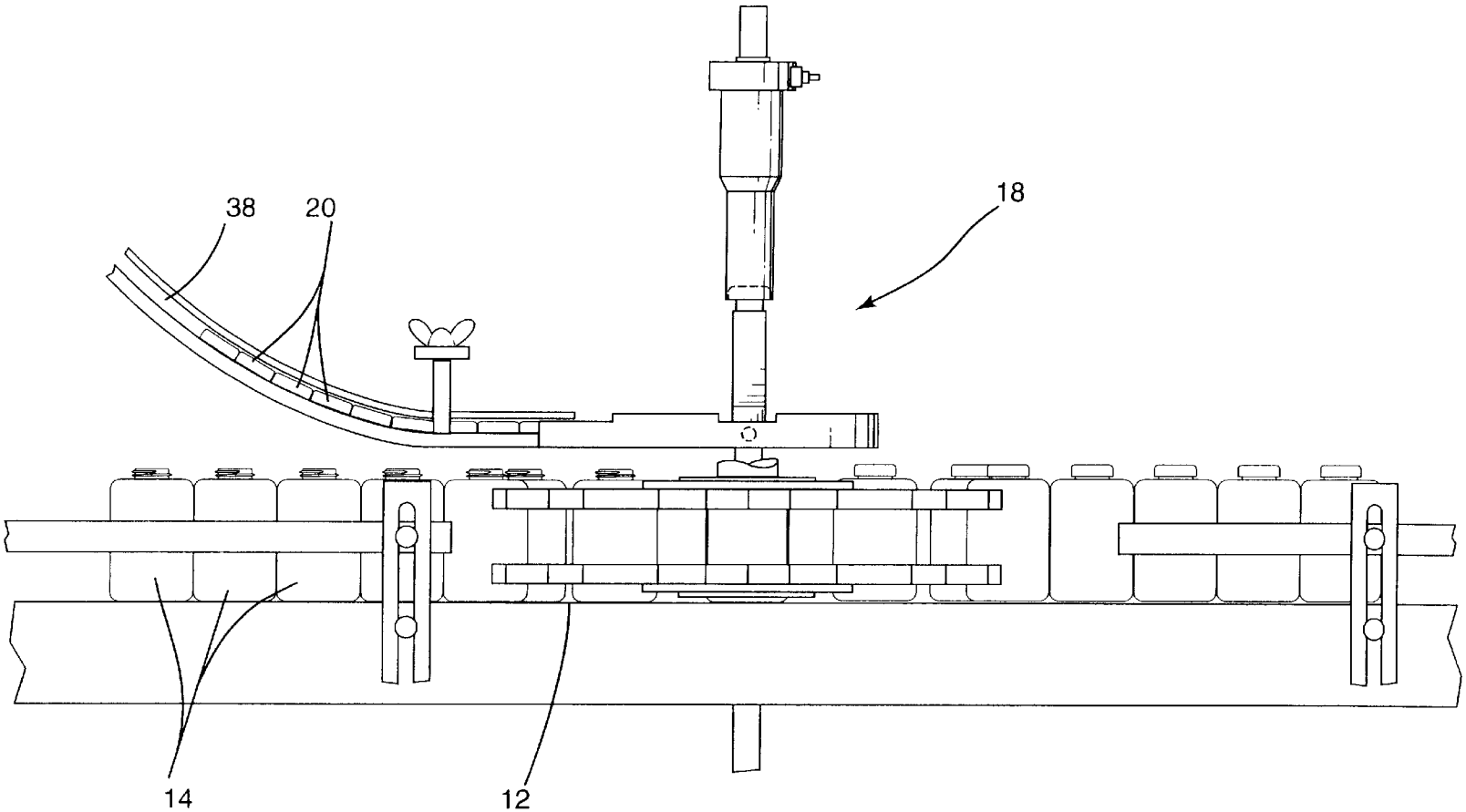
FIG. 2 is a side elevational view of the machine shown in FIG. 1, some elements being omitted for clarity.
Figure 3:
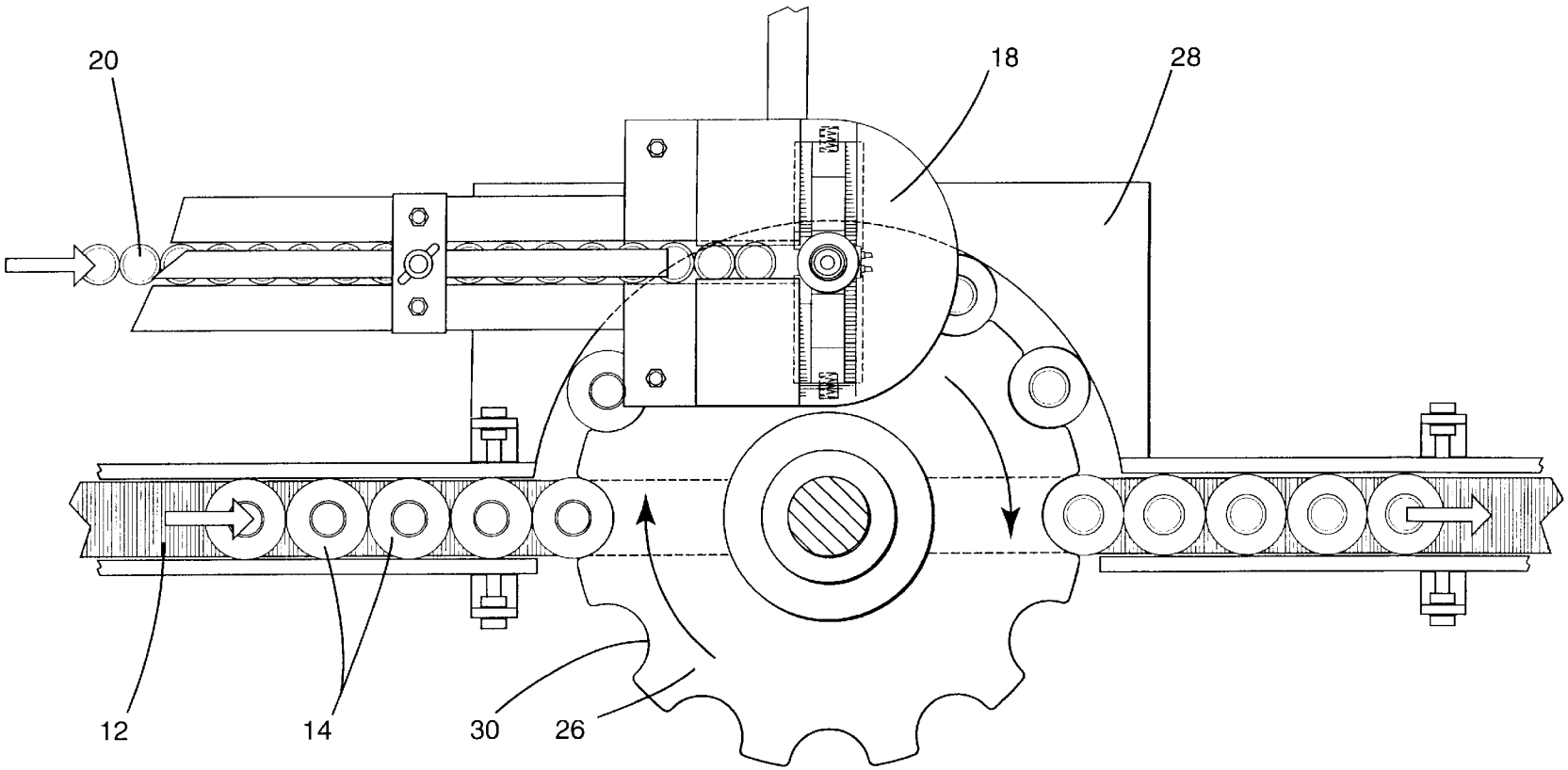
FIG. 3 is a top plan view of the machine shown in FIG. 1, some elements being omitted for clarity.

FIGS. 1 to 3 illustrate a capping machine 10, according to a specific non-limiting example of implementation of the present invention. The capping machine 10 includes a conveyor belt 12 that is responsible for transporting in serial order containers 14 that are sealed at a capping assembly 16 and then returned to the conveyor belt 12 for further processing. The capping assembly 16 includes a cap dispensing station 18 loosely applying a cap 20 on the threaded neck of a container 14, and cap-tightening stations 22 and 24 that pre-tighten and apply the final tightening torque to the caps 20, respectively.

Specific to this example of implementation, the operation of the various stations of the capping assembly 16 is precisely synchronized with the feed-rate of the containers 20 through the machine 10. Each container 14 is maintained captive during its passage through the various stations of the capping assembly 16 between a stepper wheel 26 rotating in short and essentially uniform angular movements and an arcuate guide rail 28. The stepper wheel 26 advances each container 14 in discrete steps through the machine 10 precisely positioning the container 14 at the various processing stations. In a particular example, the stepper wheel 26 has double sprocket-like configuration exhibiting a series of container-holding recesses 30 whose shape is selected according to the configuration of the containers 14 to be capped. Power is transmitted to the stepper wheel 26 through a vertically extending shaft 32 from a motor (not shown) housed in a top console 34 also regrouping the various controls of the machine 10.

Screw-type caps 20 are supplied to the machine 10 from a supply chamber 36. Such a supply chamber 36 is well known to those skilled in the art and accordingly will not be described in further detail. From the supply chamber 36, the caps 20 are conveyed to the cap dispensing station 18 by sliding under the effect of gravity on a channel 38.

Figure 4:
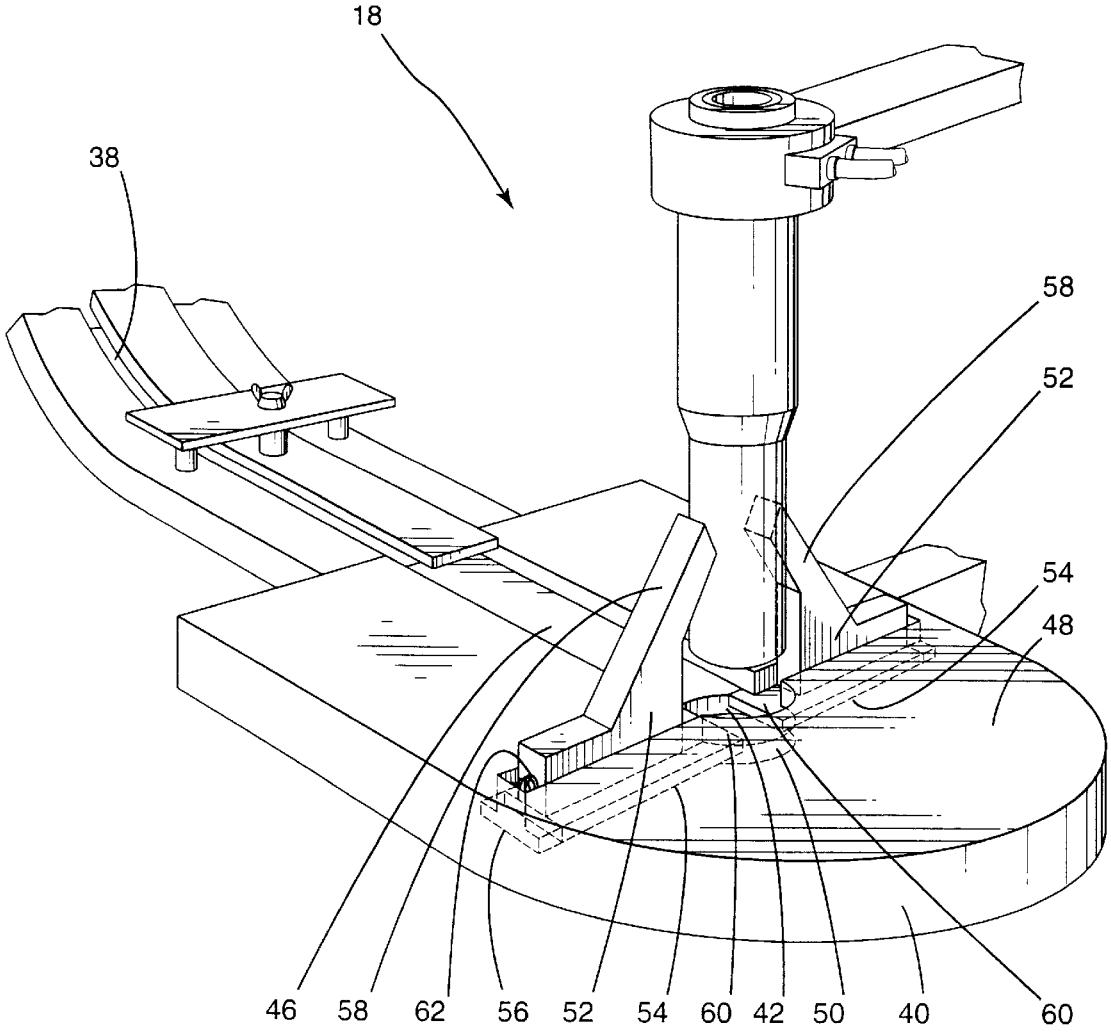
FIG. 4 is an enlarged perspective view of the cap dispensing station of the machine shown in FIGS. 1 to 3.
Figure 5:
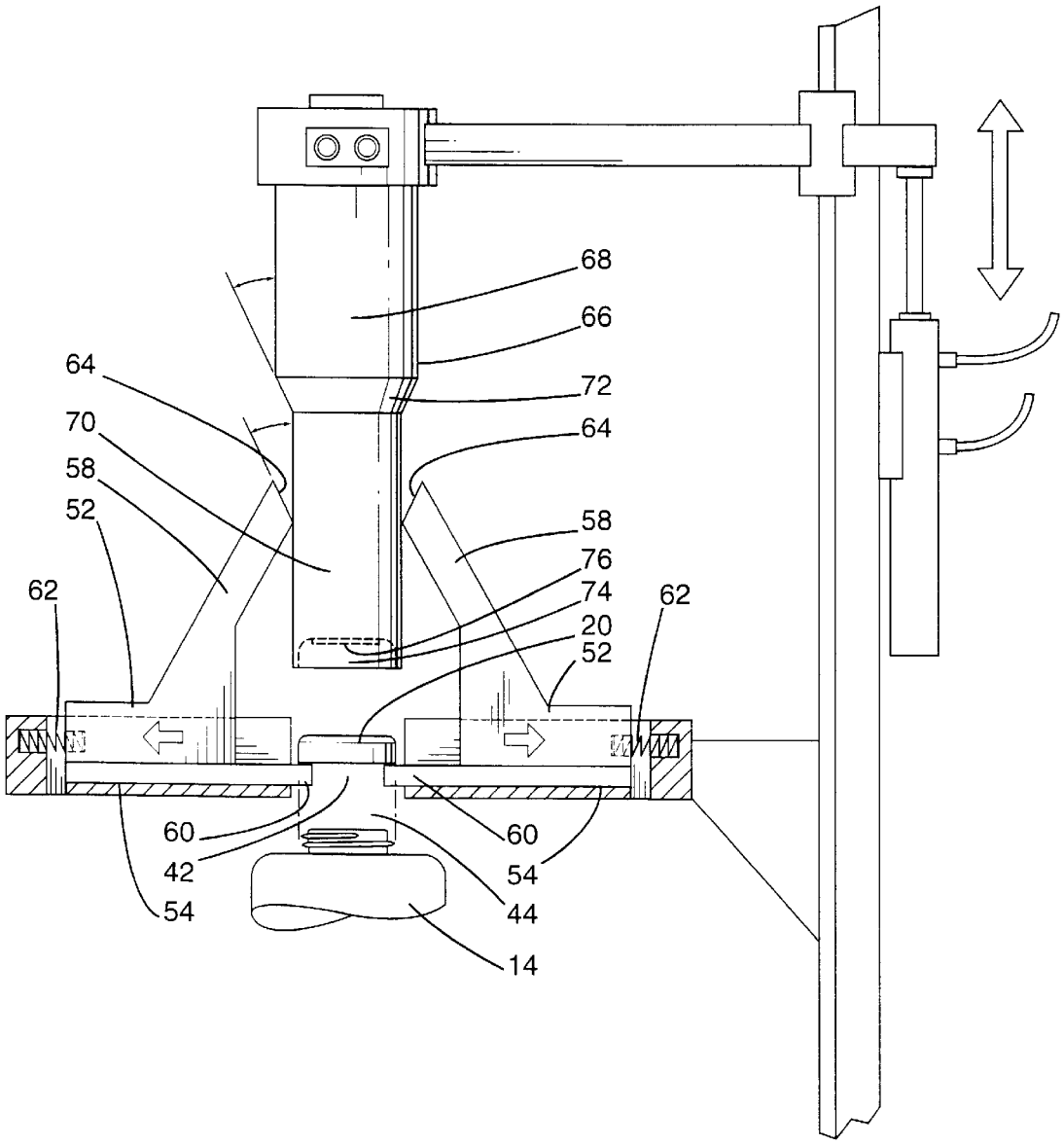
FIG. 5 is a further enlarged front view of the cap dispensing station shown in FIG. 4.

As shown in FIGS. 4 and 5, the cap dispensing station 18 includes a gating unit 40 forming the terminal area of the channel 38, itself including an aperture 42 for releasing the caps 20 onto the containers 14 passing underneath. This aperture 42 forms, at least in part, a cap release passage 44. The gating unit 40 controls the movement of a cap 20 through the cap release passage 44.

From a functional point of view, the gating unit 40 includes a barrier and a barrier drive mechanism. The barrier is associated with the cap release passage 44 and may acquire either one of first and second operative positions. In the first operative position, the barrier at least partially closes the cap release passage 44 in order to prevent a cap from freely travelling through the passage 44 under the effect of gravity. In the second operative position, the barrier uncovers the cap release passage 44 in order to allow a cap 20 to travel through the passage 44 onto a container 14 underneath. The barrier drive mechanism is associated with the barrier and causes the barrier to move between the first and second operative positions.

Continuing with the example of implementation shown in FIGS. 4 and 5, the gating unit 40 includes a bottom plate 46 that exhibits the aperture 42 and an upstanding U-shaped cap guide 48 whose central curved portion 50 follows peripherally the aperture 42. Two substantially identical members 52 are mounted to the top surface of the bottom plate 46, fitting into corresponding slots 56 in the U-shaped cap guide 48. The members 52 are spring-loaded and slide along tracks 54 of the bottom plate 46. Each member 52 comprises an arm 58 coupled at its base to a horizontally extending barrier portion 60, where displacement of an arm 58 causes simultaneous displacement of the respective barrier portion 60. The springs 62 bias the members 52 such that, at rest, the arms 58 are in a spaced-apart relationship, symmetrically positioned about the vertical axis defined by the center of aperture 42. Further, the barrier portions 60 extend into and partially close the aperture 42, preventing a cap 20 from freely travelling through the cap release passage 44 under the effect of gravity. Thus, arms 58 form, at least in part, the barrier drive mechanism of the gating unit 40, associated with the barrier formed of barrier portions 60.

Note that when the members 52 are at rest, such that the barrier portions 60 extend into the aperture 42, the barrier portions 60 form a horizontal resting surface for supporting a cap 20 above the cap release passage 44.

Each arm 58 includes an upper wall 64 that, as it progresses downwards towards the base of the arm 58, angles inward towards the vertical axis. The upper walls 64 of the arms 58 thus form together a tapered cylindrical area.

A movable, selectively actuatable cap ejector 66 is provided immediately above the aperture 42, having a path of travel coinciding with the vertical axis defined by the centerline of the aperture 42. In a particular, non-limiting example of implementation, the cap ejector 66 includes cylindrical top and bottom portions 68 and 70, respectively, the top portion 68 being characterized by a wider cross-section diameter than that of the bottom portion 70. The top 68 and bottom 70 portions are integrally connected by a ramp portion 72 that progressively angles inward towards the vertical axis as it extends downwards from the top portion 68 to the bottom portion 70. Specifically, the ramp portion 72 of the cap ejector 66 defines a tapered cylindrical portion that is dimensioned to match the tapered cylindrical area formed by the upper walls 64 of the arms 58. Note that the bottom portion 70 of the cap ejector 66 has a diameter that is substantially equal to the largest diameter of the cap 20. This diameter is also substantially equal to or smaller than the shortest distance separating the arms 58 of the members 52 at rest.

The cap ejector 66 is actuatable to engage the arms 58 of the gating unit 40, such that the members 52 are displaced and the barrier portions 60 caused to uncover the cap release passage 44, thus allowing a cap 20 to be deposited on a container 14 located underneath the cap release passage 44. Further, the cap ejector 66 is responsible for grasping the cap 20 and transporting the cap 20 towards the container 14 to be capped. In a particular example of implementation, the cap ejector 66 includes a gripping device that engages and holds a cap 20 during the movement of the cap 20 through the cap release passage 44. This gripping device includes a recess 74 for receiving at least a portion of a cap 20, the recess 74 being terminated within the bottom portion 70 of the cap ejector 66 by a rubber surface 76 for ensuring good contact between the cap 20 and the recess 74. The walls of the recess 74 surrounding the cap 20 are operative to guide the cap 20 onto the neck of the container 14.

In operation, open containers 14 which have been previously filled with the desired material are transported on the conveyor belt 12. In the vicinity of the capping assembly 16, the containers 14 are deflected from their normal course by the stepper wheel 26 guiding and advancing the containers 14 through the various processing stations of the machine 10.

The stepper wheel 26, turning in uniform angular movements, brings a container 14 immediately below the cap dispensing station 18, the neck of the container 14 being aligned with the cap release passage 44 defined by the aperture 42. Screw-type caps 20 to be applied to the containers 14 are fed to the cap dispensing station 18 through the channel 38. The cap 20 in the most advanced position on the channel 38, arriving at the gating unit 40, slides forwardly on the plate 46 and abuts against the curved portion 50 of the U-shaped guide 48, which positions the cap 20 above the aperture 42, partially closed by the barrier portions 60 of the members 52 which prevent the cap 20 from dropping on the container 14 underneath.

Figure 8:
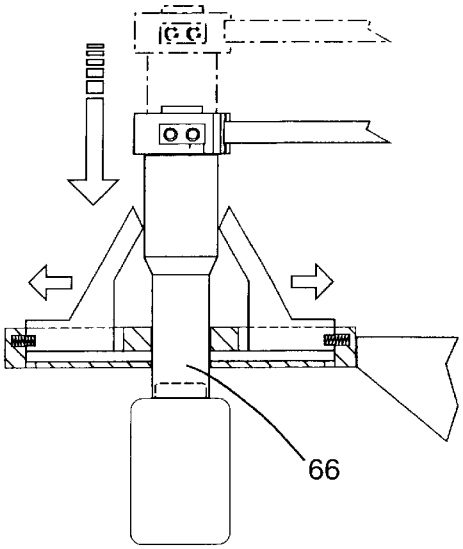
FIGS. 6 to 8 depict the operation of the cap dispensing station.
Figure 7:
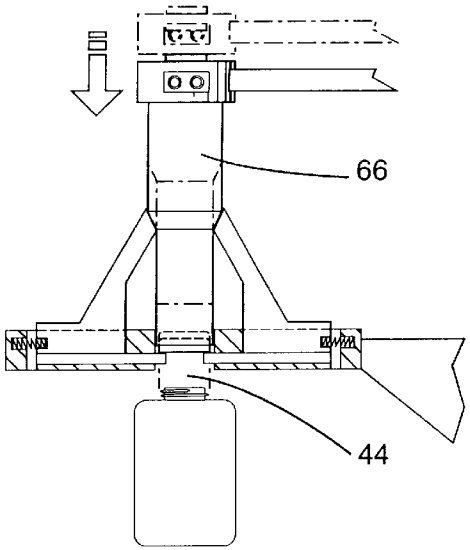
Figure 6:
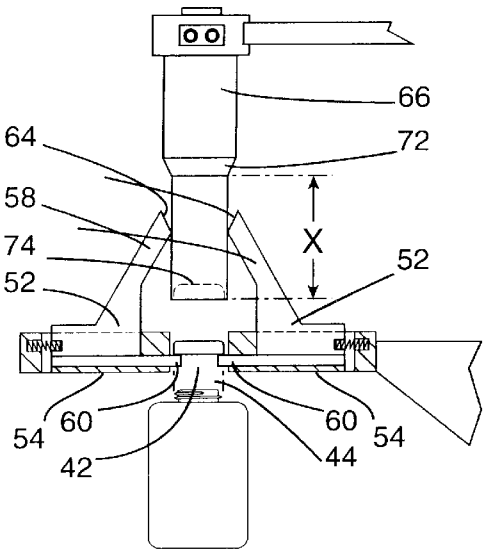

As shown in FIGS. 6 to 8, the cap ejector 66 is actuated, lowering such that the ramp portion 72 engages the upper walls 64 of the arms 58. The progressive downward motion of the cap ejector 66 causes the ramp portion 72 to exert a lateral force on the arms 58, resulting in opposite lateral movement of the members 52, and thus of the barrier portions 60, along tracks 54, away from the vertical axis defined by the center of the aperture 42. As the barrier portions 60 are displaced, they progressively uncover the cap release passage 44.

The ramp portion 72 of the cap ejector 66 is positioned a specific distance X from the base of the cap ejector 66 in order to ensure that, during actuation of the cap ejector 66, the cap release passage 44 is completely uncovered by the barrier portions 60 prior to the moment at which the base of the cap ejector 66 reaches the top surface of the bottom plate 46. Further, the distance X is calculated such that the recess 74 of the cap ejector 66 has received at least a portion of the cap 20 prior to the moment at which the barrier portions 60 completely uncover the cap release passage 44, such that the cap 20 is grasped by the recess 74 during its travel onto the container 14 underneath.

Note that in an alternative example of implementation, the members 52 may be pivotally mounted to the dispensing unit 40. In operation, the cap ejector 66 would be actuated to engage the arms 58 of the gating unit 40, the continuous downward motion of the cap ejector 66 causing a pivotal movement of the arms 58 with respect to the gating unit 40. This pivotal movement of the arms 58 would cause displacement of the barrier portions 60 in a direction such as to uncover the cap release passage 44.

Thus, once the cap release passage 44 has been completely uncovered, the cap 20 and cap ejector 66 (the cap 20 being contained within the recess 74 of the cap ejector 66) travel through the cap release passage 44 towards the container 14 underneath. During the downward motion of the cap 20, through the cap release passage 44 and onto the container 14, the walls of the recess 74 in the cap ejector 66 are operative to prevent the cap 20 from moving sideways or tilting, effectively achieving a guiding function during the cap 20 downward travel distance. To complete the cap dispensing cycle, once the cap 20 has been deposited on the container 14 neck, the cap ejector 66 is retracted, back up through the cap release passage 44 to its initial position. In accordance with the removal of the cap ejector 66, the members 52 of the gating unit 40 are biased by the springs 62 back to their initial, rest position, such that the barrier portions 60 once again extend into and at least partially close the cap release passage 44. Thus, a subsequent cap 20 may enter the gating unit 40 and be positioned above the aperture 42, prevented from descending therethrough onto a container 14 underneath by the barrier portions 60.

In order for this guiding function to be achieved throughout the downward motion of the cap 20, such that a proper alignment condition is achieved between the cap 20 and the container 14 neck, the distance between the top edge of the container 14 neck and the bottom surface of the plate 46 must be equal to the cap height. Before each production run, the distance from container 14 to bottom surface of plate 46 must be set according to the dimensions of the containers and cap to be processed.

It should be appreciated that the cap ejector 66 and the members 52, in combination, form a latch system to control the cap release onto the containers 14. This latch system is extremely effective while remaining mechanically simple and generally impervious to wear by repeated use.

The structure of the gating unit 40 will depend on the configuration of the cap 20 that is to be dispensed. Due to the simplicity of this component, various dispensing units may be easily fabricated to suit different cap shapes and sizes so as to render the machine versatile for use in applying screw-type caps of different kinds. However, each gating unit 40 will be provided with the necessary tracks and slots to receive the members 52.

Simultaneous with the retraction of the cap ejector 66 at the completion of the cap dispensing cycle, the stepper wheel 26 is advanced to bring the container 14 in a position for engagement by the first tightening station 22 where the cap 20 is partially tightened. The wheel 26 is then revolved again to bring the container 14 to the second tightening station 24 where the final tightening torque is applied to the cap 20. The structure and operation of the tightening stations 22 and 24 will not be described in further detail because they are well known to those skilled in the art.

Figure 9:
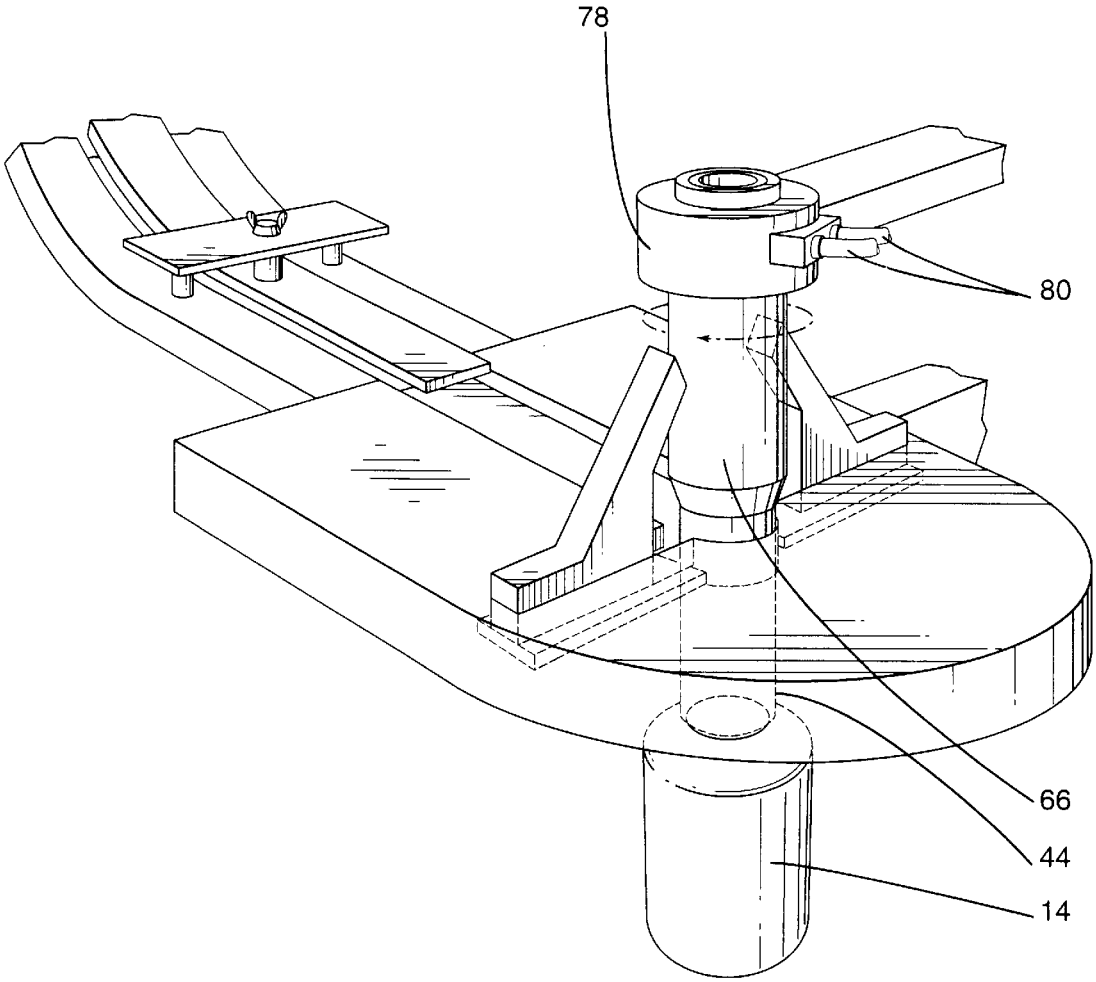
FIG. 9 is an enlarged perspective view of the cap dispensing station, according to a first variant.

In an alternative, non-limiting example of implementation, an air motor 78, in driving relationship with the cap ejector 66, imparts a rotational movement to the cap ejector 66, as shown in FIG. 9. Flexible compressed air supply lines 80 are connected to the motor 78 to supply driving fluid thereto at various vertical positions of the motor. In operation, when the cap ejector 66 is actuated to eject a cap 20 from the cap release passage 44, a continuous rotational movement is imparted to the cap 20 by the cap ejector 66 when the cap 20, contained at least partially within the recess 74 of the cap ejector 66, has cleared the aperture 42 and is being deposited on the container 14 neck. The rotational movement imparted to the cap 20 during its deposit on the container 14 causes the cap 20 to be threadedly engaged on the container 14 neck. Accordingly, the cap 20 may be both deposited and subsequently tightened on the container 14 neck by the cap ejector 66, potentially removing the requirement for one or both tightening stations 22 and 24. Note that, in this example of implementation, the recess 74 of the cap ejector 66 is sized to receive a cap 20 such that the cap 20 extends slightly from the base of the cap ejector 66, to allow for tightening of the cap 20 onto the container 14 neck.

Figure 10:
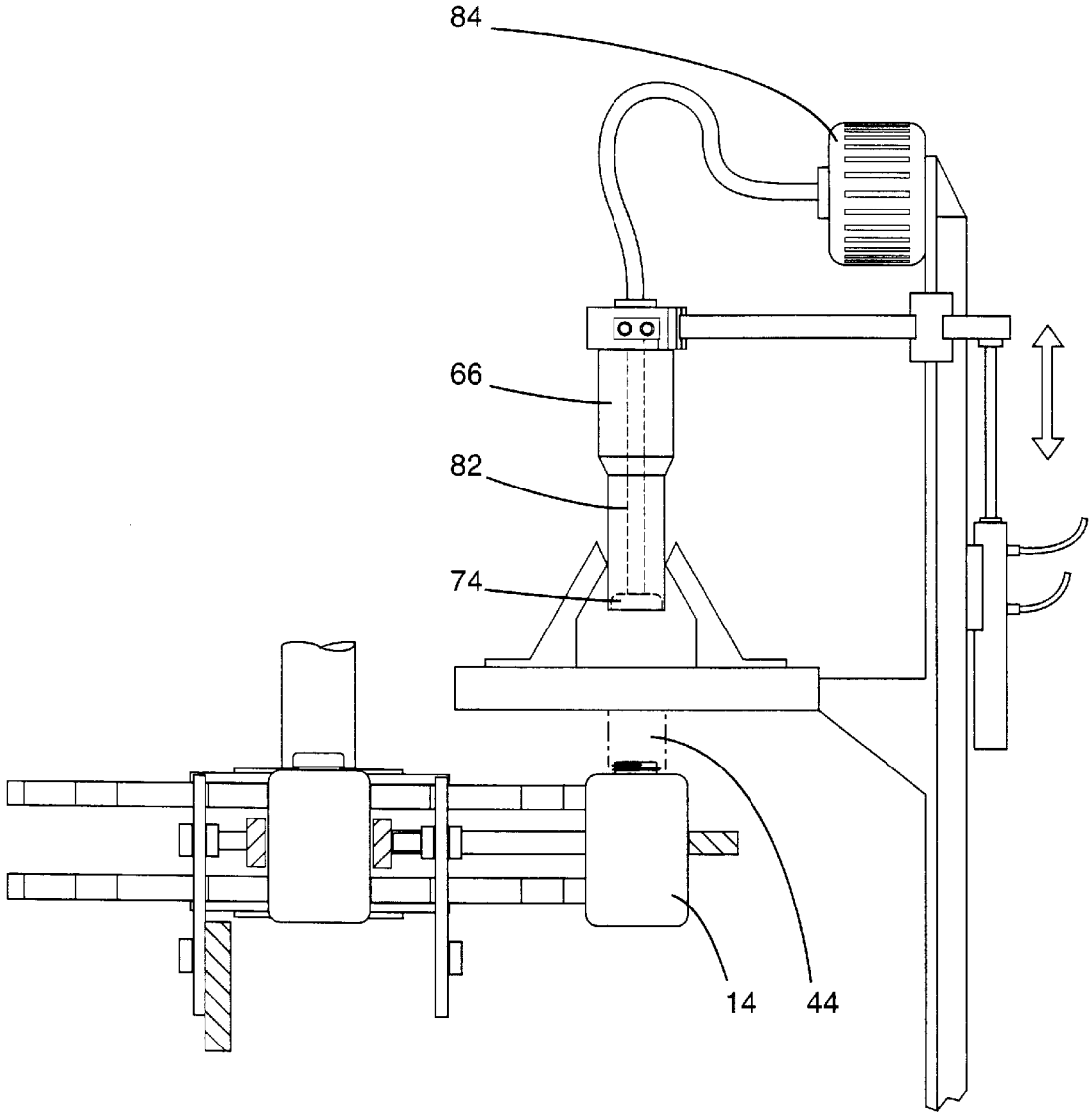
FIG. 10 is an enlarged side view of the cap dispensing station, according to a second variant.

As shown in FIG. 10, in yet another alternative, non-limiting example of implementation, the gripping device of the cap ejector 66 includes a fluid communication channel 82. The fluid communication channel is coupled at one end to a vacuum unit 84 and, at the other end, terminates in the recess 74. The vacuum unit 84 selectively establishes an air pressure differential in the recess 74, for maintaining the cap 20 in the recess 74. This air pressure differential holds the cap 20 in the recess 74 of the cap ejector 66, against the force of gravity, during deposit of the cap 20 onto the container 14 neck. The air pressure differential is terminated once the cap ejector 66 has reached the container 14 and the cap 20 is supported by the container 14, allowing the cap 20 to be released from the cap ejector 66. The rubber surface 76 of the recess 74 ensures good contact between the cap 20 and the fluid communication channel 82, such that the air pressure differential established by the vacuum unit 84 is properly applied to the cap 20 within the recess 74.

An advantage provided by this particular example of implementation is that the distance between the top edge of the container 14 neck and the bottom surface of the plate 46 may be greater than the cap height, since the air pressure differential established by the vacuum unit 84 ensures that the cap 20 is held within the recess 74 of the cap ejector 66 during the entire downward deposit motion. Note that the fluid communication channel 82 may include a valve, not shown, for controlling the flow of air within the channel 82.

Note that in an alternative embodiment of the present invention, the caps 20 are snap-type caps (no threads), where a container 14 is sealed with a snap-type cap 20 by simply snapping the cap 20 onto the neck of the container 14. The above examples of implementation of the capping machine 10 apply equally to snap-type caps. It should be noted that in the case of snap-type caps, the capping machine 10 may exclude the tightening stations 22 and 24 (for tightening screw-type caps 20 onto containers 14), as well as the air motor 78 (for imparting a rotational movement to the cap ejector 66).

The above detailed description should not be interpreted in any limiting manner as refinements and variations can be made without departing from the spirit of the invention. The scope of the invention is defined in the appended claims and their equivalents.

I claim:

1. An apparatus to cap in succession containers transported on a conveyance device, said apparatus comprising a cap dispensing station to apply caps on the containers, said cap dispensing station including:

a cap release passage;

a gating unit including:

a) a barrier associated with said cap release passage, said barrier capable to selectively acquire a first operative position and a second operative position, in said first operative position said barrier at least partially closing said passage for preventing a cap from freely traveling through said passage under the effect of gravity, in said second operative position said barrier uncovering said passage for allowing a cap to pass through said passage;

b) a barrier drive mechanism associated with said barrier;

a movable cap ejector for engaging said drive mechanism, in response to engagement with said cap ejector said drive mechanism causing said barrier to acquire said second operative position.

2. An apparatus as defined in claim 1, wherein said cap ejector includes a gripping device for engaging and holding a cap, said cap ejector being movable to carry the cap through said cap release passage towards a container.

3. An apparatus as defined in claim 2, wherein said gripping device includes a recess for receiving at least a portion of the cap.

4. An apparatus as defined in claim 3, wherein said gripping device is operative to selectively establish in said recess an air pressure differential for maintaining the cap in said recess.

5. An apparatus as defined in claim 4, wherein said gripping device includes a fluid communication channel having first and second ends, the second end of said fluid communication channel terminating at said recess, said first end being capable of being coupled to a vacuum source for establishing the pressure differential in said recess.

6. An apparatus as defined in claim 5, wherein said gripping device is operative to selectively release the cap such that the cap is deposited on the container.

7. An apparatus as defined in claim 6, wherein said gripping device includes a valve in said fluid communication channel to control a flow of air therein.

8. An apparatus as defined in claim 2, wherein said apparatus further comprises a motor in driving relationship with said cap ejector for imparting a rotational movement to the cap such that the cap is threadedly engaged on the container.

9. An apparatus as defined in claim 8, wherein said cap ejector is movable along a path of travel coinciding with a centerline of said cap release passage.

10. An apparatus as defined in claim 9, wherein said path of travel is coincident with an axis of rotation of the cap for threadedly engaging the cap on the container.

11. An apparatus as defined in claim 1, wherein said barrier drive mechanism includes a pair of arms, said barrier including at least a pair of portions, each arm being mounted to a respective portion of said barrier.

12. An apparatus as defined in claim 11, wherein said arms project in the path of travel of said cap ejector, wherein during a movement of said cap ejector along said path of travel said cap ejector engages said arms and causes said arms to move respective portions of said barrier such that said barrier acquires said second operative position.

13. An apparatus as defined in claim 12, wherein when said cap ejector engages said arms, said cap ejector causes said arms to move in opposite directions.

14. An apparatus as defined in claim 13, wherein said barrier when in said first operative position defines a surface for supporting a cap above said cap release passage.

15. An apparatus as defined in claim 1, wherein said cap dispensing station loosely applies on each container a cap in an alignment condition with the neck of the container, said apparatus further comprising a cap tightening station downstream of said cap dispensing station to rotatably grip the cap loosely applied to the container to tighten the cap.

16. An apparatus as defined in claim 1, wherein said cap dispensing station includes a cap supply chamber and a feed path to convey caps from said supply chamber toward said cap release passage.

17. An apparatus as defined in claim 16, wherein said feed path terminates with said cap release passage, further comprising a guide member adjacent to said cap release passage, said guide member constituting means to direct a cap incoming on said feed path towards said cap release passage.

18. An apparatus as defined in claim 17, wherein said guide member is curved.

19. An apparatus as defined in claim 1, further comprising a wheel advancing containers to be capped stepwise through said apparatus.

20. An apparatus as defined in claim 1, wherein said conveyance device is a conveyor belt.

* * * * *